United States Patent [19]

Finney

[11] 4,072,626

[45] Feb. 7, 1978

[54] AMINE SALT COMPOSITION USEFUL IN INHIBITING METAL CORROSION

[75] Inventor: Donald C. Finney, Bellevue, Pa.

[73] Assignee: A. F. Industries, Inc., Pittsburgh, Pa.

[21] Appl. No.: 676,158

[22] Filed: Apr. 12, 1976

[51] Int. Cl.[2] ..... C23F 11/00

[52] U.S. Cl. ..... 252/389 A; 252/388; 252/392; 106/14; 106/196; 21/2.7 A; 21/2.7 R; 428/464

[58] Field of Search ..... 252/388, 392, 389 A; 106/14, 196; 21/2.7 A, 2.7 R; 260/501.1; 428/464

[56] References Cited

U.S. PATENT DOCUMENTS

| | | | |
|---|---|---|---|
| 2,330,524 | 9/1943 | Shields | 260/501.1 X |
| 2,837,432 | 6/1958 | Drigot et al. | 106/14 |
| 3,839,051 | 10/1974 | Cerveny | 106/196 X |
| 3,960,735 | 6/1976 | Lacey | 252/389 A X |

*Primary Examiner*—Benjamin R. Padgett
*Assistant Examiner*—E. Suzanne Parr
*Attorney, Agent, or Firm*—Robert D. Yeager

[57] ABSTRACT

An amine salt is comprised of the reaction of pelargonic acid and dicyclohexylamine. The amine salt, dicyclohexylammonium pelargonate, is useful for inhibiting metal corrosion. A polyphosphate may be used in conjunction with the amine salt to obtain a synergistic corrosion inhibiting effect when a saline environment is encountered by the metal to be protected.

8 Claims, No Drawings

AMINE SALT COMPOSITION USEFUL IN INHIBITING METAL CORROSION

BACKGROUND OF THE INVENTION

1. Field of the Invention

This invention relates to amine salt compositions and more particularly to amine salt compositions useful for inhibiting corrosion.

2. Description of the Prior Art

Corrosion is the deterioration of a metal caused by the chemical or electrochemical reaction of the metal with the constituents of its environment. The corrosion of iron is referred to as rusting whereas, in other metals, corrosion is referred to as tarnishing or some other phenomena.

Corrosion has accompanied metals since their beginning and has caused extensive research for the prevention thereof. Corrosion not only affects the surface properties of a particular metal but also can cause deterioration in metal strength. This deterioration is due not only to the reduction in metal thickness but also in the strength of the metal itself.

In designing articles constructed of metal, it is necessary to consider the inevitability of corrosion, hence, the metal may have to be coated or constructed of a special alloy to endure in a specific environment.

There are many types of corrosion among which are uniform attack, pitting, fretting, cavitation-erosion, dezincification, intergrannular corrosion and cracking. Although these types of corrosion cause various effects, in all cases, a deterioration is manifested.

The specific problems of corrosion in commerical areas are too vast to provide a specific enumeration thereof. But the major problems include shipment of metal from the mill to the user with a minimum of alteration through corrosion. For example, silicon steel, as is used in electrical transformers, tends to corrode in the edge area where the steel has been cut due to the lack of coating (which provides the desired electrical properties) about the edge. Thus, it may be necessary to coat the steel with a composition having detrimental electrical properties after the cutting operation and remove the coating before use in a transformer.

Another problem presented by corrosion is the necessity of providing special shipping containers for high tolerance steel articles such as bearings, cams, gears, fasteners, machine parts and the like. For example, steel bearings, just as the above mentioned articles, are coated with a polymer such as cellulose acetate butyrate to protect the bearings from damage due to impact. However, because the polymer contains residual acetic and butyric acid, care must be taken to prevent moisture from contacting the steel and causing corrosion. Thus, it has become necessary to pack the bearings in special containers for corrosion protection such as the provision of silica get in the container, packing in hard wood boxes, wrapping with a moisture impermeable material, or wrapping with a cloth or paper impregnated with a corrosion inhibitor.

Further, in the production and fabrication of steel in mills, several steps may be necessary to manufacture a particular product. In between each of these steps, there is usually a time delay which allows the steel to corrode and necessitates the removal of the rust before the steel is transferred to the next process. When welding is used in a fabrication process, in many instances the surfaces to be joined are ground free of contaminants and the component parts stored before welding. During the course of this storage, the steel may rust on the edges and a poor weld joint will be formed if the adjoining surfaces are not reground.

In accordance with the present invention a corrosion inhibitor is provided which has wide potential application in the metal industry.

BRIEF DESCRIPTION OF THE INVENTION

An amine salt is comprised of the reaction of pelargonic acid and dicyclohexylamine. The amine salt, dicyclohexylammonium pelargonate, is useful for inhibiting metal corrosion. A polyphosphate may be used in conjunction with the amine salt to obtain a synergistic corrosion inhibiting effect when a saline environment is encountered by the metal to be protected.

DETAILED DESCRIPTION OF THE INVENTION

The amine salt of the invention is produced by the reaction of pelargonic (n-nonanoic) acid and dicyclohexylamine.

Pelargonic acid is characterized by the structural formula:

$$CH_3CH_2CH_2CH_2CH_2CH_2CH_2CH_2\overset{\overset{\displaystyle O}{\|}}{C}OH$$

and is synonomous with n-nonanoic acid and n-nonylic acid.

Dicyclohexylamine is characterized by the structural formula:

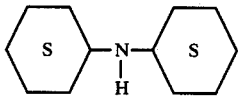

with the S denoting that the ring is saturated.

The salt of pelargonic acid and dicyclohexylamine is characterized by the structural formula:

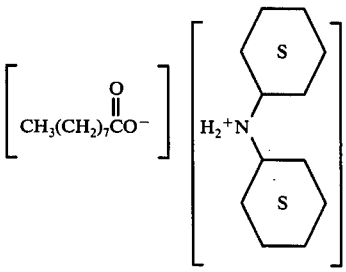

and can be called dicyclohexylammonium pelargonate (DCHP).

DCHP may be formed by methods of preparing salts known to those skilled in the art. DCHP may be prepared in neat form by mixing the pelargonic acid and dicyclohexylamine with agitation. It is preferred that a stochiometric amount of the two constituents are used, however an excess of either the acid or amine will not hinder salt formation but only alter the final pH of the salt.

Because the neat salt is a solid at room temperature, a preferred method of preparing the salt is in the presence of a solvent.

Among the solvents useful in preparing the salt are the aliphatic hydrocarbon solvents such as hexane, heptane, mineral spirits, Stoddard solvent and the like; the cycloaliphatic hydrocarbon solvents such as cyclohexane, methylcyclohexane, dimethylcyclohexane and the like; the aromatic solvents such as benzene, toluene, xylene, ethyl benzene and the like; the ketone solvents such as acetone, methyl ethyl ketone and the like.

In preparing the salt, it is most advantageous to use 50 to 90 percent by weight of the solvent to 10 to 50 percent by weight of the amine and acid. The reaction temperature should be below the boiling point of the solvent used or under refluxing conditions. When the solvent boils above the boiling point of the amine, the reaction temperature should be below 134° C (the boiling point of dicyclohexylamine), unless refluxing apparatus is provided.

The particular solvent used is dependent on the desired form of the salt. For example, if the neat salt is desired acetone or a solvent of similar polarity should be used with the reaction conducted at reflux or below reflux. The pelargonic acid is added to the amine acetone solution. After all of the amine and acid are combined, the solution is cooled to room temperature or below and the DCHP salt precipitates. The mixture can be filtered and the filtrate recovered and dried as the neat DCHP.

If the product desired is a solution of DCHP, an aliphatic or cycloaliphatic solvent should be used. Thus, the pelargonic acid is preferably dissolved in the solvent and the amine is added thereto. After addition of the amine, the solvent may be stripped or the DCHP in solution form may be used in spraying or painting the metal to be protected.

If the DCHP is to be used in conjunction with a lubricant, the pelargonic acid and dicyclohexylamine may be added directly to the lubricant. The DCHP solution may be used on the metal to both lubricate and inhibit corrosion.

The addition order of the pelargonic acid and dicyclohexylamine has no effect on the final salt and is a matter of convenience or choice. Further, the pelargonic acid and dicyclohexylamine may be added simultaneously to the reaction vessel to form the DCHP.

The DCHP may be applied to the metal surface by a plurality of methods or may be physically incorporated into a particular material which is applied to the metal as for example, a lubricant.

By way of illustration, in the manufacture of wire rope a lubricant known as Klingold manufactured by Brooks Oil Co. which is an asphaltic base lubricant containing molybdenum disulfide, is utilized to lubricate the individual strands of the rope to protect them against abrasion. In order to impart corrosion resistant properties to the Klingold, about 1 to 10 percent by weight of DCHP may be incorporated therein to form a homogeneous corrosion inhibiting lubricant. The DCHP may be added to the Klingold in neat form, in a solvent, or may be formed in situ by adding the acid and amine to the Klingold.

In the case of silicon coated steel, a 5 to 30 percent solution of DCHP in an aliphatic hydrocarbon may be sprayed on the surface of the steel to form a 0.01 to 1.0 mil film as DCHP to prevent corrosion of the steel edge.

In machinery which operates in the presence of a lubricating oil, such as automotive transmissions and the like, the DCHP may be added to the oil at a level of 0.5 to 20 and preferably 1 to 10 percent by weight to prevent corrosion.

In cases where galvanic corrosion is a problem, DHCP when contacting the metal surfaces inhibits such corrosion. For example, when copper and aluminum are used in the same power transmission system, galvanic corrosion may build at and around the contact points of the diverse metals. Usually a grease containing sufficient graphite to efficiently conduct electricity is applied to these joints to prevent electrical losses. An addition of about 1 to 10 and preferably 5 to 7 percent by weight of DCHP to the graphite inhibits the galvanic corrosion.

DCHP in aqueous solution may be used in water recirculation systems wherein the materials which contact the water have a potential to corrode. By way of illustration, in the grinding of metal ores in ball mills and rod mills, the steel grinding objects which contact the ore corrode and wear rapidly. A level of about 0.25 to 1 percent by weight of DCHP in the recirculating water system provides for corrosion inhibition thus allowing the grinding objects to be useful for a longer period of time.

Further, DCHP may be added to a light machine oil to lubricate prosthetic devices to prevent corrosion in the joints thereof.

A gelatinous corrosion inhibitor with the characteristics of a grease may be prepared by forming the DCHP or mixing the DCHP with mineral oil. A level of 30 to 50 percent by weight of DCHP in mineral oil will render a corrosion inhibiting grease.

When applied to a metal surface, a film thickness of about 0.001 to 2.5 mils particularly 0.01 to 0.5 mils as DCHP is necessary to prevent corrosion of the metal. The upper limit is for the sake of convenience and economy. In general, a 0.01 to 30 percent by weight solution of DCHP is desirable in application to most metals.

In addition to being a corrosion inhibitor DCHP may be used in solution with a light oil to form a penetrating oil. One to fifteen percent by weight of DCHP in a light oil is an effective penetrant. The final DCHP/oil solution has a viscosity of greater than 0.25 centipoise and more preferably 0.25 to 10 centipoise. Oil/DCHP solutions used as penetrating oils are useful in releasing corroded bolts, brake cables and the like.

Further, DCHP has been found to be an excellent fungicide not only for removing accumulated fungus but also for preventing new growth. For example, a light oil, as described in the previous paragraph was applied to leather saddles and bridles to remove fungus which had accumulated thereon. The DCHP oil solution also inhibited the growth of new fungus.

When used herein "film" means both continuous and discontinuous films.

The phrase "as DCHP" is used herein to account for any reaction of the DCHP on the metal. Therefore, film thickness levels are those which if the film on the metal were analyzed would be measured in terms of effective thickness of DCHP.

Additionally, DCHP may be added to coating compositions such as linseed oil, polyurethane, acrylic or similar vehicles to provide as corrosion inhibiting coating composition.

When a saline environment is to be encountered by the metal to be protected such as metals in bilge tanks and those used in construction of marine equipment 10 to 500 and preferably 100 to 300 parts by weight of a polyphosphate per one million parts by weight of DCHP will further inhibit corrosion.

The polyphosphates useful for addition to DCHP solutions are but not limited to the lithium, sodium and potassium ortho, meta and pyrophosphates and preferably sodium orthophosphate, sodium metaphosphate and sodium pyrophosphate.

Although both the DCHP and polyphosphate inhibit corrosion in saline environments, a synergistic corrosion inhibiting effect is encountered when the DCHP and the polyphosphate are combined.

The following examples are by way of illustration and are not intended to limit the invention.

EXAMPLE I

The pelargonic acid salt of dicyclohexylamine is prepared by charging 80 parts of water to a suitable vessel and adding 10.68 parts of dicyclohexylamine at ambient temperature thereto. To the dicyclohexylamine solution is added 9.32 parts of pelargonic acid (nonanoic acid) with agitation. The resultant product is a 20 percent by weight aqueous solution of dicyclohexylammonium pelargonate. Dicyclohexylammonium pelargonate is characterized by the structural formula:

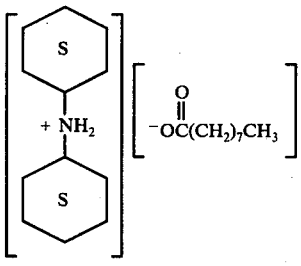

EXAMPLE II

Three 1 × 1 ½ × ⅛ inch wafers, one each of steel, copper and aluminum are placed in a 2 ounce jar. The jar is filled with tap water and capped thereby immersing the samples under the water. The jar with the metal wafers and water therein is aged at 105° F for 24 hours. Inspection of the samples shows severe corrosion and an orange precipitate has accumulated in the jar.

EXAMPLE III

Three 1 × 1 ½ × ⅛ inch wafers, one each of steel, copper and aluminum are placed in a 2 ounce jar. The jar is filled with tap water and 1.77g of the 20 percent aqueous solution of dicyclohexylammonium perlargonate (DCHP) of Example I is added thereto, thus producing a 0.25 weight percent solution of DCHP contacting the metal. The jar is capped and aged at 105° F; after six months of aging no corrosion is observable.

Examples I through III demonstrate that DCHP is an effective inhibitor against galvanic corrosion.

EXAMPLE IV

An alcoholic solution of dicyclohexylammonium pelargonate (DCHP) is prepared by charging 80 parts of ethyl alcohol to a suitable vessel and adding 10.68 parts of dicyclohexylamine thereto. To the dicyclohexylamine solution is added 9.32 parts of pelargonic acid with agitation. The resultant product is a 20 percent by weight alcoholic solution of DCHP.

EXAMPLE V

A 1 × 1 ½ × ⅛ inch wafer of galvanized steel is placed in a 2 ounce jar and is provided with an inert support at the bottom of the jar. Tap water is added to the jar to below the supporting surface. The jar is capped and aged at 105° F. for 3 days, inspection of the sample shows a patch of corrosion thereon. The aging temperature is raised to 175° F. and after 6 days of aging at 175° F. inspection of the sample shows heavy corrosion.

EXAMPLE VI

Example V is repeated except the galvanized steel wafer is coated with DCHP by applying with a paint brush one coat of the 20 percent alcoholic solution of DCHP prepared in Example IV. After heat aging in accordance with Example V there is no evidence of corrosion at either 105° F. or 175° F.

EXAMPLE VII

A 1 × 1 ½ × ⅛ inch wafer of steel is placed in a 2 ounce jar. The jar is filled with tap water, capped and aged at 105° F. for 1 day and then the temperature is raised to 175° F. Test results of Example VII and Examples VIII-XII are reported in Table II.

EXAMPLES VIII–XII

Example VII is repeated except after the jar is filled with water, various amounts of the 20 percent DCHP ethanolic solution of Example IV is added. The following table shows the concentration in percent by weight of DCHP in the jar water.

TABLE I

| Example | Concentration (%) | Remarks |
|---|---|---|
| VIII | 0.25 | Milky Admixture |
| IX | 0.12 | Slightly Milky |
| X | 0.06 | Slightly Milky |
| XI | 0.03 | Clear |
| XII | 0.01 | Clear |
| | 12. | |

Table II shows the results of aging at 105° F. and 175° F. of Examples VII-XII.

TABLE II*

| Ex. | % DCHP | Aging after 1 Day (105°) | 5 Days (175°) | 8 Days (175°) |
|---|---|---|---|---|
| VII | NONE | Severe Rust | Severe Rust | Severe Rust |
| VIII | 0.25 | No Visible Rust | Discontinued | |
| IX | 0.12 | No Visible Rust | Discontinued | |
| X | 0.06 | No Visible Rust | Discontinued | |
| XI | 0.03 | No Visible Rust | No Visible Rust | No Visible Rust |
| XII | 0.01 | No Visible Rust | No Visible Rust | No Visible Rust |

*The aging tests reported in Table II were run pursuant to an extinction test to determine the lowest level of DCHP effective to inhibit corrosion.

EXAMPLE XIII

A 1 × 1 ½ × ⅛ inch steel wafer is placed in a 2 ounce jar. The jar is filled with water and capped. The sample is aged for 1 year and showed extreme rusting.

EXAMPLE XIV

A 1 × 1 ½ ⅛ inch steel wafer is placed in a 2 ounce jar. The jar is filled with a 0.25 weight percent aqueous solution of DCHP and capped. After one year, the sample shows no visible rusting.

EXAMPLE XV

Sponge iron pellets are placed in a 2 ounce jar; the jar is filled with water and sealed. After 10 days at room temperature the pellets show a light rust coating.

EXAMPLE XVI

Example XV is repeated except the jar is filled with a 0.25 weight percent aqueous solution of DCHP. After 10 days at room temperature there is no evidence of rusting.

EXAMPLE XVII

A steel plate showing light rust is coated with a 2 mil film of a 7% DCHP/boiled linseed oil solution. After 3 months of exterior aging, the coated portion of the steel shows the same amount of rust present as when the steel was initially coated. Uncoated portions of the steel showed severe rusting.

EXAMPLE XVIII

A $1 \times 1\frac{1}{2} \times \frac{1}{8}$ inch steel wafer is encased with about a 50 mil film of cellulose acetate butyrate. The cellulose acetate butyrate is the type used for the stripable packaging of bearings and like machinery parts to prevent impact damage during shipment. The cellulose acetate butyrate is stripped off the steel and both the steel and cellulose acetate butyrate are placed in a 2 ounce jar filled with tap water. The capped jar is aged for one month at ambient temperature. The steel shows extreme rusting after aging.

EXAMPLE XIX

Example XVIII is repeated except the cellulose acetate butyrate encasing the steel contains 5 percent by weight DCHP. After 1 month aging in accordance with Example XVIII, no rust is observable. Thus when 0.5 to 10 percent by weight of DCHP is incorporated into cellulose acetate butyrate, a stripable film forming material is provided which protects metal against both impact and corrosion. The cellulose acetate butyrate used for stripable packaging has resilient characteristics and is comprised of a cellulose acetate butyrate polymer and a plasticizer such as dioctylphthalate or the like.

EXAMPLE XX

A $1 \times 1\frac{1}{2} \times \frac{1}{8}$ inch wafer of silicon steel such as is used in the construction of electrical transformers is placed in a 2 ounce jar, filled with tap water and capped. The sample is aged one month at room temperature. After aging the steel shows severe rusting on the edges of the wafer.

EXAMPLE XXI

A 20 percent by weight solution of DCHP in heptane is prepared by charging 80 parts of heptane to a suitable vessel and adding 10.68 parts of dicyclohexylamine at ambient temperature thereto. To the dicyclohexylamine solution is added 9.32 parts of pelargonic acid with agitation thus producing a 20 weight percent solids solution of dicyclohexylammonium pelargonate.

EXAMPLE XXII

A $1 \times 1\frac{1}{2} \times \frac{1}{8}$ inch silicon steel wafer, as described in Example XX is sprayed with the DCHP solution of Example XXI leaving a 0.05 mil film of DCHP on the steel. The sample is placed in a 2 ounce jar, filled with tap water and aged for one month at room temperature. Inspection of the aged sample shows no visible rusting or corrosion.

EXAMPLE XXIII

A $1 \times 1\frac{1}{2} \times \frac{1}{8}$ inch silicon steel wafer, as described in Example XX is placed in a humidity cabinet at 105° F. and 100% relative humidity. After aging for 24 hours, corrosion on the edges of the sample is evident.

EXAMPLE XXIV

A $1 \times 1\frac{1}{2} \times \frac{1}{8}$ inch silicon steel wafer, as described in Example XX, is sprayed with the DCHP of Example XXI leaving a 0.05 mil film of DCHP thereon. The sample is placed in a humidity cabinet at 105° F. and 100% relative humidity. After aging for 1 week the sample shows no visible rust or corrosion.

EXAMPLE XXV-XXVIII

Direct reduced sponge iron pellets are dipped in the DCHP solution of Example IV. Some of the pellets are subjected to exterior exposure for three months (Example XXV) some of pellets are placed in a humidity cabinet at 105° F. and 100% relative humidity for 5 weeks (Example XXVI). Controls with no DCHP thereon were provided for both the exterior exposure test (control Example XXVII) and the humidity cabinet test (control Example XXVIII). The pellets of Examples XXV and XXVI showed light corrosion after aging while control Examples XXVII and XXVIII show severe corrosion.

EXAMPLE XXIX

A $1 \times 1\frac{1}{2} \times \frac{1}{8}$ inch steel wafer is placed in a 2 ounce jar. The jar is filled with sea water, capped and aged for three months at ambient temperatures. After aging the steel is severely corroded.

EXAMPLE XXX

A $1 \times 1\frac{1}{2}$ inch steel wafer is placed in a 2 ounce jar. The jar is filled with sea water and a sufficient amount of a 20 percent aqueous solution of DCHP is added to provide a 0.25 percent solution of DCHP in the jar. Two hundred parts per million of sodium metaphosphate based on the weight of DCHP is added to the jar. After aging for three months at ambient temperature, very light corrosion is exhibited.

EXAMPLE XXXI

An aluminized steel panel is coated with an acrylic based clear paint known as Tectyl 151A and aged in a humidity cabinet at 105° F. and 100 percent relative humidity for 240 hours. After aging, the aluminized steel panel shows extreme corrosion.

EXAMPLE XXXII

Example XXXI is repeated except 10 percent by weight of DCHP is incorporated into the paint. After aging in accordance with Example XXXI, no corrosion is evident.

EXAMPLE XXXIII

An uncoated aluminized steel panel is tested in accordance with Examples XXXI and XXXII. The aged panel shows light rusting.

As is illustrated by the above Examples, dicyclohexylammonium pelargonate is an effective corrosion inhibitor for metals. Also the DCHP may be used in various forms which are adaptable to a variety of applications. Further, due to water impurities encountered in different geographic areas more or less concentrated DCHP solutions than those recited may be used. It has been found that the higher the purity of the water, the less DCHP is needed to inhibit corrosion.

Although the invention has been described with reference to specific uses and application techniques, the invention is only to be limited as is set forth in the accompanying claims.

EXAMPLE XXXIX

A 2 ½ inch friction bushing bearing lubricated with a light oil was loaded in a vise. The shaft of the bearing was turned under constant torque with a ½ horsepower motor. The jaws of the vice were brought together to load the bearing until the bearing seized. A 5 percent by weight DCHP solution in mineral oil was applied to the bearing. The shaft turned freely after the application of the DCHP solution.

I claim:

1. A composition comprising:

a. dicyclohexylammonium pelargonate; and, b. a polyphosphate; said (a) and (b) being present in sufficient amounts to inhibit metal corrosion in a saline environment.

2. The composition of claim 1 wherein said polyphosphate is present at a level of 10 to 500 parts per one million parts of dicyclohexylammonium pelargonate.

3. The composition of claim 1 wherein (a) and (b) are in an aqueous solution.

4. A method of inhibiting corrosion comprising contracting a corrosion susceptible surface with a corrosion inhibiting solution consisting essentially of dicyclohexylammonium pelargonate and an effective amount of a polyphosphate to inhibit corrosion in a saline environment.

5. The method of claim 4 wherein said polyphosphate is present at a level of 10 to 500 parts by weight per one million parts by weight of dicyclohexylammonium pelargonate.

6. The method of claim 5 wherein said polyphosphate is present at a level of 100 to 300 parts per one million parts of dicyclohexylammonium pelargonate.

7. In an impact absorbing composition suitable for coating metal articles to protect said articles from impact damage, said composition containing cellulose acetate butyrate as the impact absorbing constituent, the improvement comprising:

an effective amount of dicyclohexylammonium pelargonate to inhibit the corrosion of said metal article.

8. The composition of claim 7 having therein: 90 to 99.5 parts by weight of cellulose acetate butyrate; and, 0.5 to 10 parts by weight of dicyclohexylammonium pelargonate.

* * * * *

UNITED STATES PATENT AND TRADEMARK OFFICE

CERTIFICATE OF CORRECTION

PATENT NO. : 4,072,626

DATED : February 7, 1978

INVENTOR(S) : Donald C. Finney

It is certified that error appears in the above-identified patent and that said Letters Patent are hereby corrected as shown below.

Column 1, line 57, "get" should read --gel--.

Column 6, line 43, "12." should be deleted, line 65, after "1/2" --x-- should be added.

Claim 4, lines 1 and 2, "contracting" should read --contacting--.

Signed and Sealed this

*Twenty-third* Day of *May 1978*

[SEAL]

*Attest:*

RUTH C. MASON
*Attesting Officer*

LUTRELLE F. PARKER
*Acting Commissioner of Patents and Trademarks*